US011428392B2

(12) United States Patent
Dong et al.

(10) Patent No.: US 11,428,392 B2
(45) Date of Patent: Aug. 30, 2022

(54) LIGHTING APPARATUS

(71) Applicant: XIAMEN ECO LIGHTING CO. LTD., Xiamen (CN)

(72) Inventors: Yongzhe Dong, Xiamen (CN); Xiaoliang Wen, Xiamen (CN); Shouqiang Hou, Xiamen (CN); Qingguang Zeng, Xiamen (CN)

(73) Assignee: XIAMEN ECO LIGHTING CO. LTD., Xiamen (CN)

( * ) Notice: Subject to any disclaimer, the term of this patent is extended or adjusted under 35 U.S.C. 154(b) by 0 days.

(21) Appl. No.: 16/842,751

(22) Filed: Apr. 7, 2020

(65) Prior Publication Data

US 2020/0370740 A1 Nov. 26, 2020

(30) Foreign Application Priority Data

May 23, 2019 (CN) ..... 201920752648.2

(51) Int. Cl.

| | |
|---|---|
| ***F21S 8/02*** | (2006.01) |
| ***F21V 23/06*** | (2006.01) |
| ***F21V 23/00*** | (2015.01) |
| *F21V 29/70* | (2015.01) |
| *F21Y 115/10* | (2016.01) |

(52) U.S. Cl.

CPC ..... *F21V 23/005* (2013.01); *F21S 8/026* (2013.01); *F21V 23/06* (2013.01); *F21V 29/70* (2015.01); *F21Y 2115/10* (2016.08)

(58) Field of Classification Search

CPC ..... F21S 8/026; F21V 23/006; F21V 23/06; F21V 23/005

See application file for complete search history.

(56) References Cited

U.S. PATENT DOCUMENTS

2008/0171472 A1* 7/2008 Gu ..... G02F 1/133608 439/620.02
2017/0307143 A1* 10/2017 Shah ..... F21K 9/90

* cited by examiner

*Primary Examiner* — Karabi Guharay
(74) *Attorney, Agent, or Firm* — Chun-Ming Shih; Lanway IPR Services

(57) ABSTRACT

A lighting apparatus is designed for connecting to an external signal wire. The external signal wire has an end electrode. The lighting apparatus has a light housing, multiple LED chips, a driver component, a printed circuit board, a socket and an elastic clip. The light housing has a light opening and a back cover. The back cover has a cover entrance. The printed circuit board is used for mounting the plurality of LED chips and the driver component. The socket has a guiding entrance aligning with the cover entrance. The end electrode of the external signal wire is inserted into the guiding entrance. The elastic clip has a clip part and an extended part. The extended part is electrically connected to the driver component. The clip part clips the end electrode for forming an electrical connection to the driver component via the extended part.

13 Claims, 10 Drawing Sheets

LIGHTING APPARATUS

FIELD

The present invention is related to a lighting apparatus and more particularly related to a lighting apparatus easily to be installed to a cavity of a ceiling.

BACKGROUND

Lighting or illumination is the deliberate use of light to achieve a practical or aesthetic effect. Lighting includes the use of both artificial light sources like lamps and light fixtures, as well as natural illumination by capturing daylight. Daylighting (using windows, skylights, or light shelves) is sometimes used as the main source of light during daytime in buildings. This can save energy in place of using artificial lighting, which represents a major component of energy consumption in buildings. Proper lighting can enhance task performance, improve the appearance of an area, or have positive psychological effects on occupants.

Indoor lighting is usually accomplished using light fixtures, and is a key part of interior design. Lighting can also be an intrinsic component of landscape projects.

A light-emitting diode (LED) is a semiconductor light source that emits light when current flows through it. Electrons in the semiconductor recombine with electron holes, releasing energy in the form of photons. This effect is called electroluminescence. The color of the light (corresponding to the energy of the photons) is determined by the energy required for electrons to cross the band gap of the semiconductor. White light is obtained by using multiple semiconductors or a layer of light-emitting phosphor on the semiconductor device.

Appearing as practical electronic components in 1962, the earliest LEDs emitted low-intensity infrared light. Infrared LEDs are used in remote-control circuits, such as those used with a wide variety of consumer electronics. The first visible-light LEDs were of low intensity and limited to red. Modern LEDs are available across the visible, ultraviolet, and infrared wavelengths, with high light output.

Early LEDs were often used as indicator lamps, replacing small incandescent bulbs, and in seven-segment displays. Recent developments have produced white-light LEDs suitable for room lighting. LEDs have led to new displays and sensors, while their high switching rates are useful in advanced communications technology.

LEDs have many advantages over incandescent light sources, including lower energy consumption, longer lifetime, improved physical robustness, smaller size, and faster switching. Light-emitting diodes are used in applications as diverse as aviation lighting, automotive headlamps, advertising, general lighting, traffic signals, camera flashes, lighted wallpaper and medical devices.

Unlike a laser, the color of light emitted from an LED is neither coherent nor monochromatic, but the spectrum is narrow with respect to human vision, and functionally monochromatic.

The energy efficiency of electric lighting has increased radically since the first demonstration of arc lamps and the incandescent light bulb of the 19th century. Modern electric light sources come in a profusion of types and sizes adapted to many applications. Most modern electric lighting is powered by centrally generated electric power, but lighting may also be powered by mobile or standby electric generators or battery systems. Battery-powered light is often reserved for when and where stationary lights fail, often in the form of flashlights, electric lanterns, and in vehicles.

Although lighting devices are widely used, there are still lots of opportunity and benefit to improve the lighting devices to provide more convenient, low cost, reliable and beautiful lighting devices for enhancing human life.

SUMMARY

In some embodiments, a lighting apparatus is designed for connecting to an external signal wire. The external signal wire has an end electrode. For example, the external signal wire is a power wire with two sub-wires. The two sub-wires are isolated and prevented to have direct contact which may cause short circuit problem. In the ends of the two sub-wires, there may be two electrodes as the end electrode of the external signal wire.

More than three sub-wires may be used, e.g. with a ground line and one or more control lines. In some embodiments, the external signal wire may be a power line from an indoor power source, e.g. 110V or 220V alternating current source.

The lighting apparatus has a light housing, multiple LED chips, a driver component, a printed circuit board, a socket and an elastic clip.

The light housing has a light opening and a back cover. The back cover has a cover entrance. The printed circuit board is used for mounting the plurality of LED chips and the driver component.

The socket has a guiding entrance aligning with the cover entrance. The end electrode of the external signal wire is inserted into the guiding entrance.

The elastic clip has a clip part and an extended part. The extended part is electrically connected to the driver component. The clip part clips the end electrode for forming an electrical connection to the driver component via the extended part.

In some embodiments, the external signal wire includes a power wire.

In some embodiments, the external signal line also includes a control signal line for transmitting a control signal to the driver component for sending a control signal from an external control device via the external signal line to the driver component to control the plurality of LED chips according to the control signal. The external control device may be a switch mounted on a wall for receiving an operation command of a user. The operation command is converted to the corresponding control signal sent to the driver component. For example, the operation command may be to turn-on, turn-off, increase luminance level, lower luminance level, change color temperatures. More complicated commands may be provided by combining multiple operations with more circuits. For example, a prepare-to-sleep command may correspond to lower down the light gradually and turn off after a predetermined time period. In some embodiments, there are other components on the lighting apparatus, e.g. a speaker, a camera, a smoke detector, an indicator. The control signal may be used for control these components.

In some embodiments, the signal wire may include a signal line for transmitting a control signal.

In some embodiments, the lighting apparatus may also include a converter module. The converter module may have a box housing and electronic components placed within the box housing.

The converter module may be selectively, e.g. added when needed, inserted into a section of the external signal line for providing an additional control signal to the driver component.

For example, there is a position detachable in the external signal line. When a first part of the external signal line and a second part of the external signal line are separated, the first part and the second part respectively have a connecting end to be connected to two ends of the converter module for inserting the converter module into the external signal wire. In other words, the power line and/or signal line passes through the converter module first and then continue to the lighting apparatus.

The converter module may add more function to the lighting apparatus when the converter module is inserted. For example, the convert module may have a wireless module for transmitting and/or receiving data to and/or from an external device. The data are processed or routed to the driver component of the lighting apparatus.

The converter module may have a manual switch exposed outside the lighting apparatus so that users may operate the manual switch to input some commands, which may be further injected to the driver component of the lighting apparatus.

In some other embodiments, the converter module may replace the control function of the driver component. In other words, when the converter module is inserted, the converter module takes over a portion of a complete function of the driver module.

When users need a different function, users just get a corresponding converter module and inserts the converter module into the external signal line to achieve the desired control function provided by the converter module. For example, a lighting apparatus may have not connection capability to external devices. By inserting a convert module that has a wireless circuit as mentioned above, the lighting apparatus may be controlled by an external device wirelessly. Such design adds lots of flexibility.

In some embodiments, the lighting apparatus may also include a converter module that is selectively inserted into the external signal line for receiving a wireless signal and the control signal, the converter module converting the wireless signal to an additional control signal supplied to the driver component via the end electrode of the external signal line.

In some embodiments, the light housing further has a rim and a surrounding wall. A first peripheral edge of the surrounding wall is connected to the back cover. The light opening is at a center of the rim. The rim is connected to a second peripheral edge of the surrounding wall. Such arrangement may form a downlight device that can be installed to an installation box or an installation cavity in a ceiling.

In some embodiments, the lighting apparatus may also include a heat sink for mounting the printed circuit board for carrying away heat of the printed circuit board. The heat sink may be a metal cup with a top plate and a surrounding wall. the top plate is used for mounting and engaging the printed circuit board for carrying away heat of the LED chips and the driver component.

In some embodiments, an external surface of the heat sink engages an inner surface of the light housing for heat dissipation. The heat is transmitted from the printed circuit board to the light housing.

In some embodiments, there is an antenna disposed on the heat sink electrically connected to the driver component. For example, there is a portion of a heat dissipation cup, served as the heat sink, reserved for placing an antenna. Usually, an antenna has a pattern, length and width for receiving a corresponding frequency signal. The antenna may be printed or inserted to the heat dissipation cup and also connect to the driver component or a wireless module to provide connectivity.

In some embodiments, the printed circuit board includes an extending slot for plugging a function module providing an additional function to the driver component. The function module may provide a wireless function, a sensor function, or other functions for making the lighting apparatus more convenient. When such function module may be added, such function module may be replaced depending on which function users need. In some cases, the function module may be removed completely and no additional function is provided for such setting, e.g. with a lower cost.

In some embodiments, the driver component and the plurality of LED chips are disposed on opposite sides of the printed circuit board. In other words, the driver component, which may have one or more circuits, is mounted on a back side of the printed circuit board and the LED chips are placed on a front side of the printed circuit board.

In some embodiments, the driver component and the multiple LED chips are disposed at a first side of the printed circuit board. There is a second driver component having a height than the driver component being disposed at a second side of the printed circuit board. In other words, components with larger heights, like a capacitor standing upon a printed circuit with a significant height compared with other components, are placed in a back side of the printed circuit board without causing a shadow of the LED chips if these components are placed at the same side of the printed circuit board as the LED chips.

In some embodiments, the printed circuit board has an extending slot for plugging a second light source module.

In some embodiments, the second light source module has a third driver component co-working with the driver component to control the second light source module.

In some embodiments, the third driver component replaces a control function of the driver component when the second light source module is plugged to the extending slot.

In some embodiments, the clip part and the extended part are made of metal material. The clip part includes a pair of clips facing to each other and defining a clipping entrance deformed when the end electrode is inserted into the clip entrance to fix the end electrode.

In some embodiments, the elastic clip has a clip housing to be disposed on the printed circuit board.

In some embodiments, the clip housing has a top part and a bottom part disposed on opposite sides of the printed circuit board. The clip part is enclosed by the top part and the bottom part of the clip housing.

In some embodiments, the printed circuit board has a wire opening. The end electrode is inserted through a guiding entrance of the top part of the clip housing and then passes through the wire opening before being clipped by the clip part of the elastic clip. In some embodiments, the light housing has a reflective cup made as an unibody portion of the light housing.

DETAILED DESCRIPTION

Figure 1:
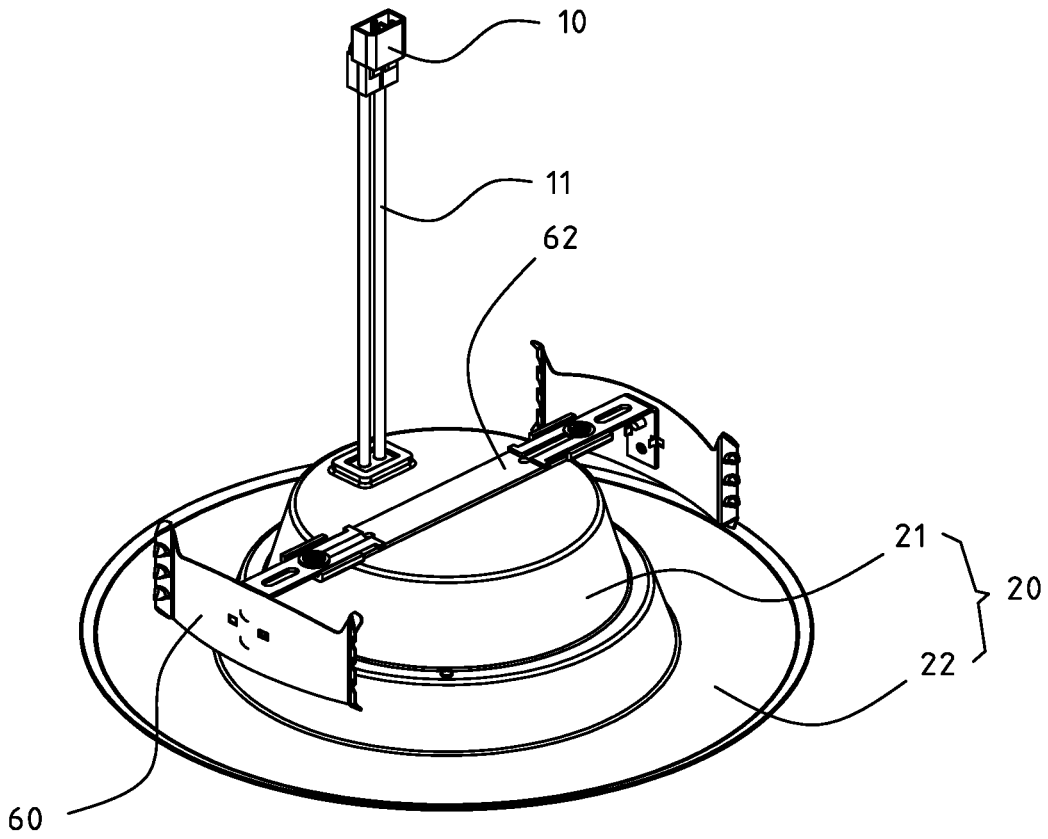
FIG. 1 shows an embodiment of a lighting apparatus.
Figure 2:
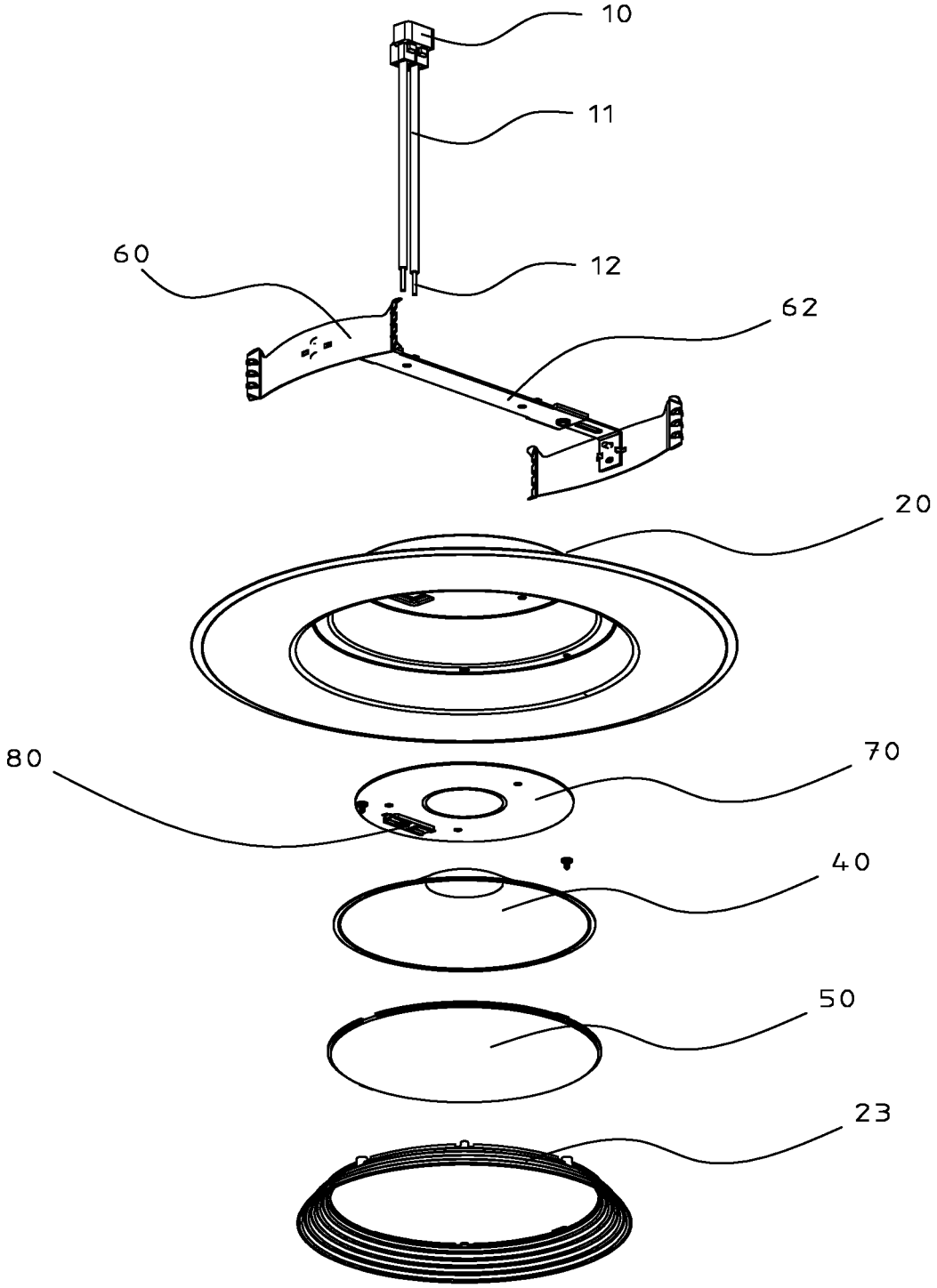
FIG. 2 shows an exploded diagram of the example in FIG. 1.
Figure 3:
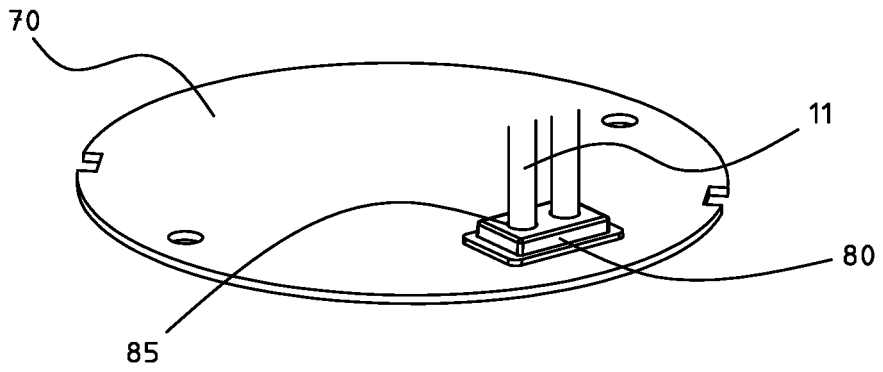
FIG. 3 shows a connector structure example.
Figure 4:
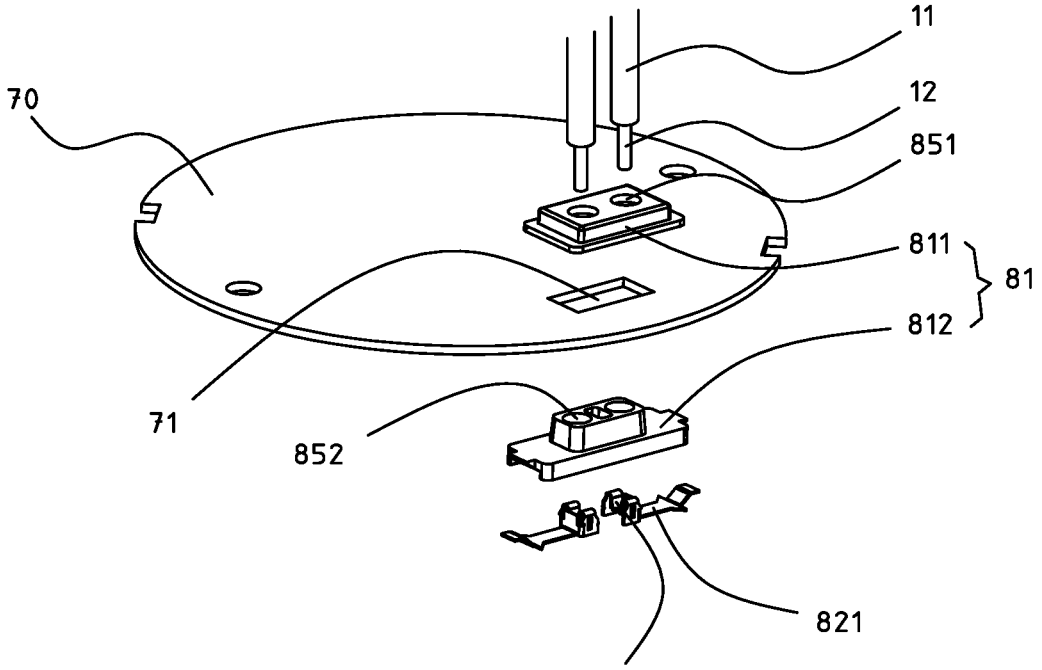
FIG. 4 shows components of the example in FIG. 3.
Figure 5:
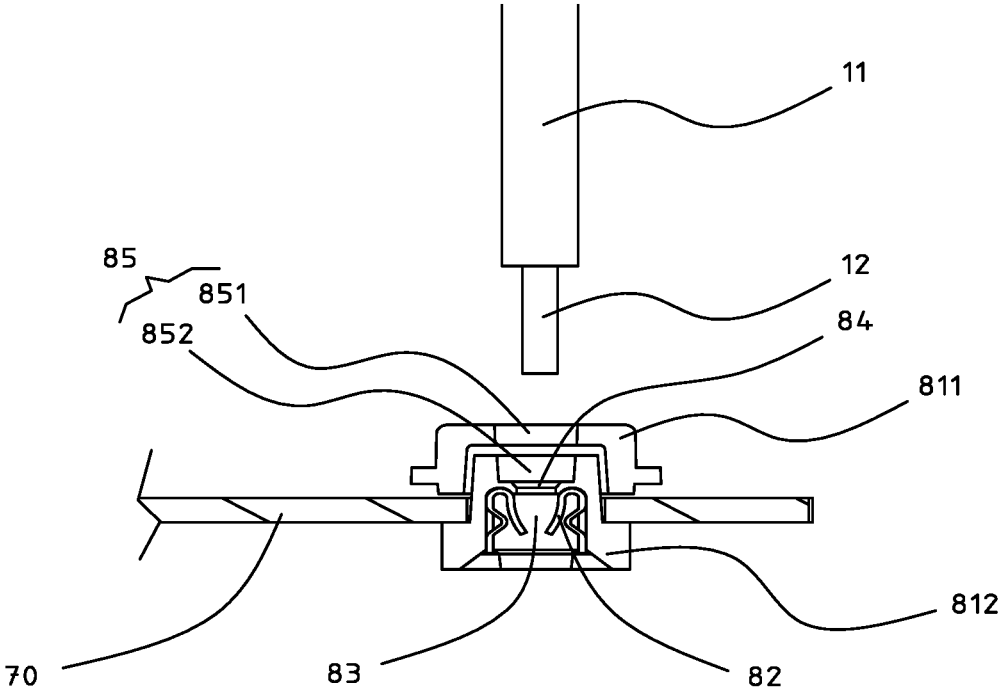
FIG. 5 shows side view of insertion of an external signal line.
Figure 6:
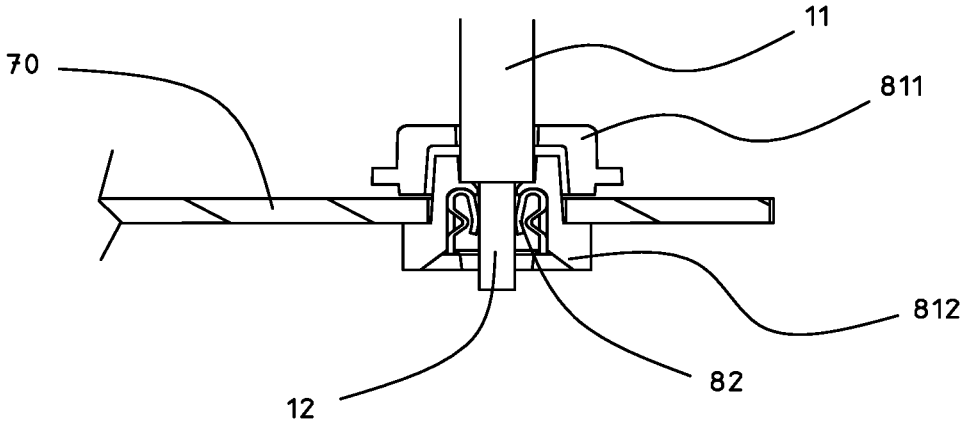
FIG. 6 shows another status of the example in FIG. 5.

Please refer to FIG. 1 and FIG. 2. A lighting apparatus includes a light body, a light source plate 70, an external signal wire 11.

The light source plate 70 is disposed in the light body. The connecting wire 11 passes through the light body and connects to the DOB light source plate 70.

The light source plate 70 has a substrate mounted with one or more than driver components, LED chips and control circuits.

The external signal wire 11 connects to an indoor power source via a connector 10 at its end.

In this example, the light body includes a heat dissipation housing 20, a decoration rim 23, a reflector cup 40, a light passing cover 50 and a flexible assembler.

The heat dissipation housing 20 includes a heat sink 21 and a rim 22 made as a unibody component. Such design lowers cost and simplifies manufacturing complexity.

The light source plate 70 uses a screw to be fixed to the heat sink 21. The reflector cup 40 and the light passing cover 50 are disposed in the heat dissipation housing 20. The decoration rim 23 is used for fixing these components together.

The flexible assembler includes a bar 62 with shrinkable elastic pieces 60. The relative distance of shrinkable elastic pieces 60 between the bar 62 is adjustable for fitting to different installation holes.

In FIG. 3, FIG. 4, FIG. 5 and FIG. 6, the external signal wire 11 is connected to the light source plate 70 with mechanic connection instead of welding. Specifically, the light source plate 70 has a socket 80. The socket 80 clips the end electrode 12 of the external signal wire 11 with the clip parts 82 of an elastic clip. The clip parts 82 are electrically connected to an extended part that is electrically connected to a driver component.

The external signal wire 11 has an end electrode 12. The socket 80 has a plugging path 83 from which the end electrode 12 is inserted and engages the clip parts 82. The clip parts 82 deforms and generates an elastic force to increase friction between the clip parts 82 and the end electrode 12 to keep the end electrode 122 fixed.

There is a guiding entrance 84 for guiding the plugging of the external signal wire 11. The guiding entrance 84 may have a cone shape with a larger diameter facing to the end electrode while a narrower diameter facing to the clip parts 82.

There is a wire opening 85 in the socket 80 connected to the guiding entrance 84. When the end electrode 12 is clipped by the clip parts 82, there is a portion of the external signal line 11 staying in the wire opening 85 to make the connection more stable.

In this example, the clip parts 82 have a V shape structure. The elastic clip also has an extended part 821 connected to one of the clip parts 82. The extended part 821 is electrically connected to a driver component on the light source plate 70.

In this example, the socket 80 includes a terminal base 81 and the clip parts 82. The plugging path 83 is disposed in the terminal base 81. The clip parts 82 are also enclosed by the terminal base 81. The terminal base 81 has a top part 811 and a bottom part 812 fixed together for containing the clip parts 82. There is a wire opening 71 formed on the light source plate 70., The wire opening 85 includes a line passing hole 851 and a limiting hole 852.

Figure 7:
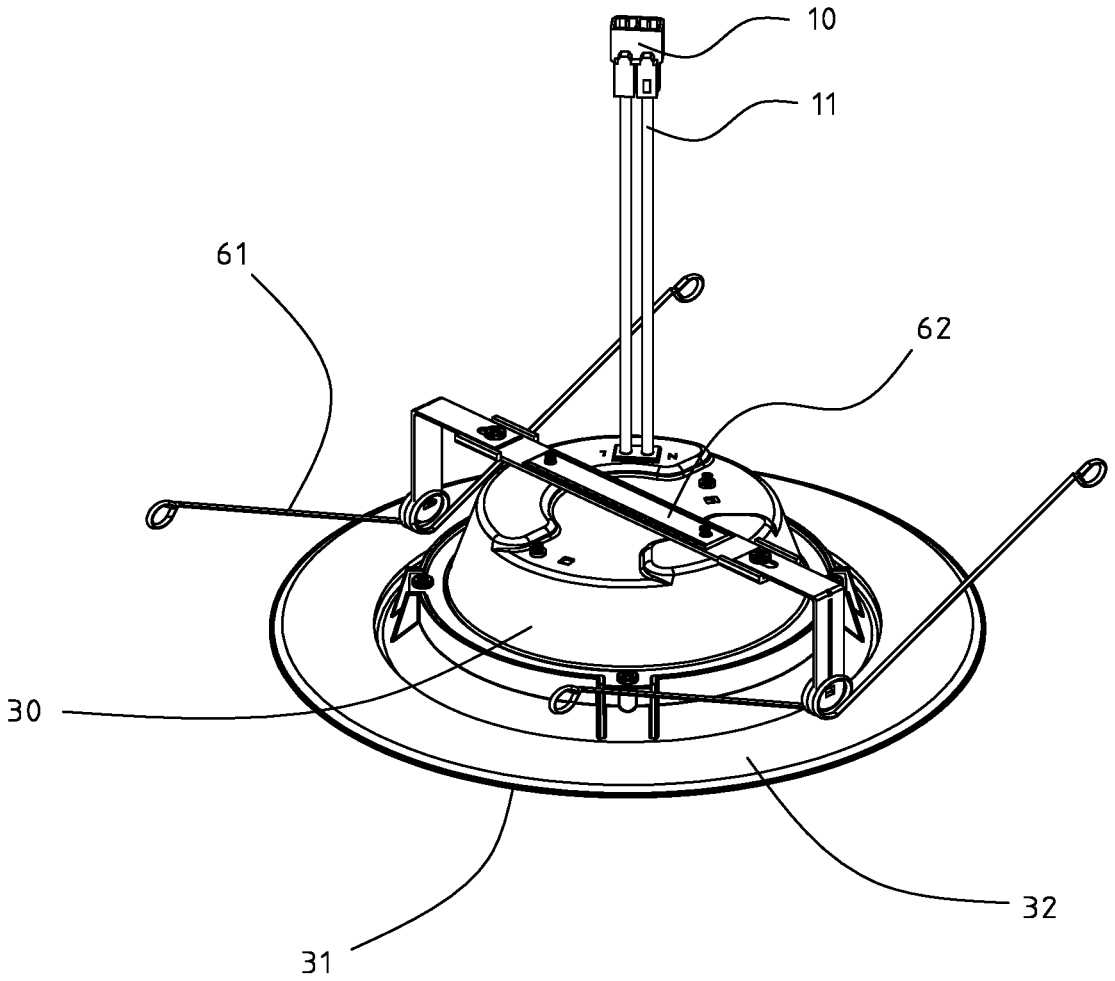
FIG. 7 shows a downlight example.
Figure 8:
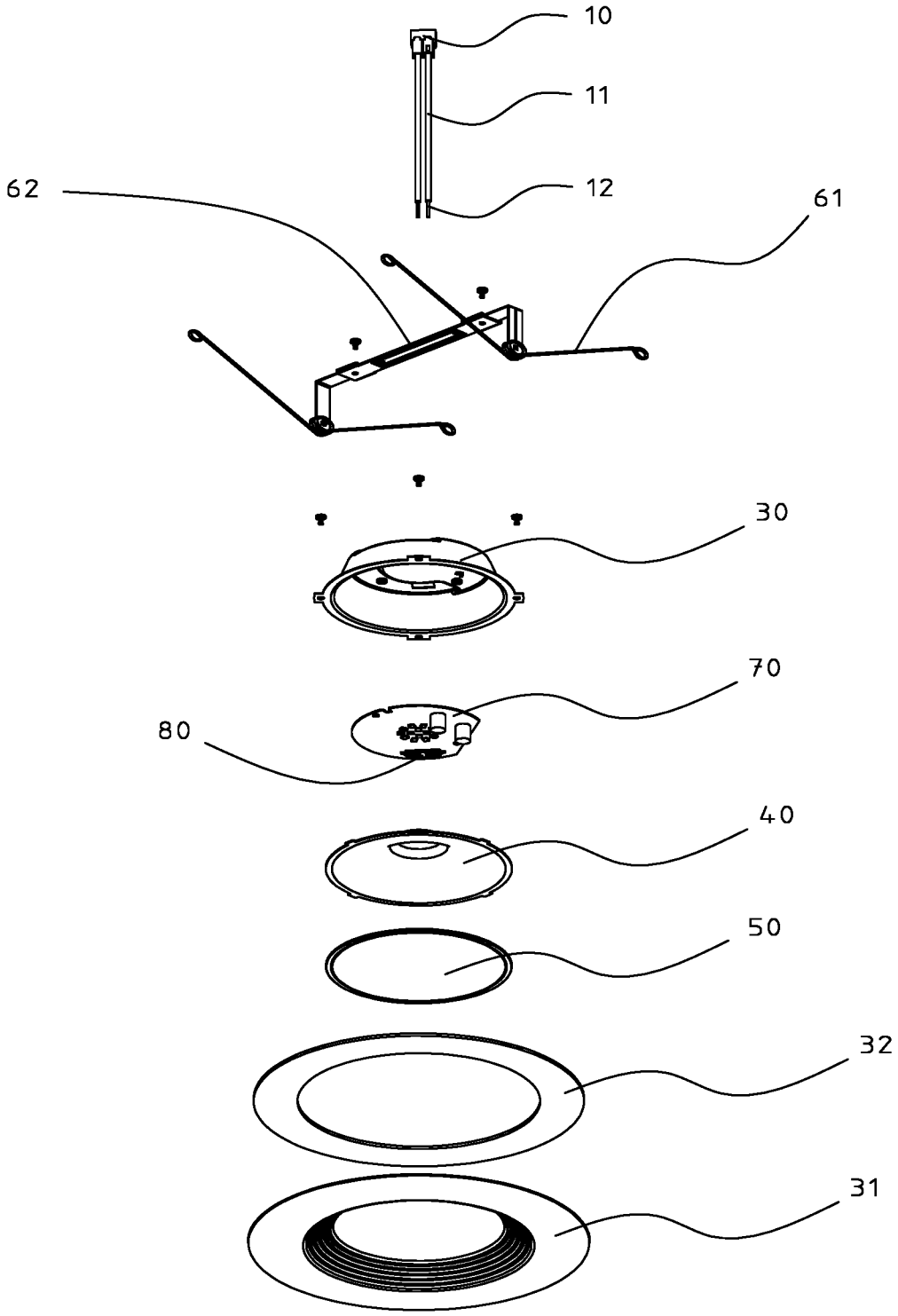
FIG. 8 shows an exploded diagram of FIG. 7.

In FIG. 7 and FIG. 8, there is a different embodiment. The bar 62 has two sprint assemblers 61. There is a heat sink 32 separated from the rim structure 31.

The lighting apparatus also has a reflector cup 40, a light passing cover 50. To make the connection more stable, there is a foam layer 32 disposed.

Figure 9:
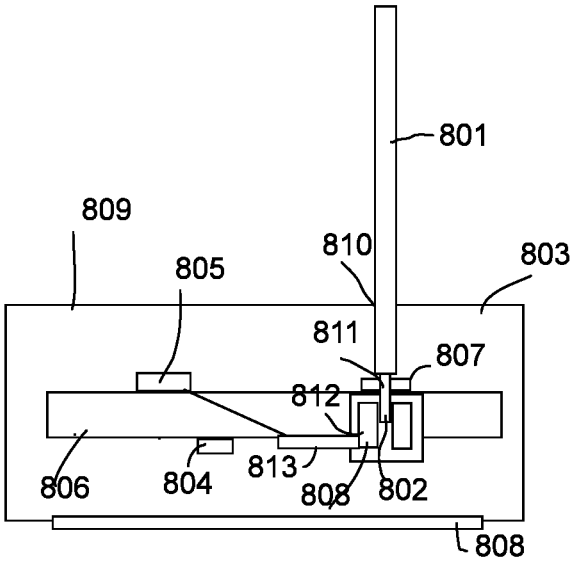
FIG. 9 illustrates concept of an embodiment.

In FIG. 9, a lighting apparatus is designed for connecting to an external signal wire 801. The external signal wire 802 has an end electrode 801. For example, the external signal wire 801 is a power wire with two sub-wires. The two sub-wires are isolated and prevented to have direct contact which may cause short circuit problem. In the ends of the two sub-wires, there may be two electrodes as the end electrode of the external signal wire.

More than three sub-wires may be used, e.g. with a ground line and one or more control lines. In some embodiments, the external signal wire may be a power line from an indoor power source, e.g. 110V or 220V alternating current source.

The lighting apparatus has a light housing 803, multiple LED chips 804, a driver component 805*t*, a printed circuit board 806, a socket 807 and an elastic clip 808.

The light housing 803 has a light opening 808 and a back cover 809. The back cover 809 has a cover entrance 810. The printed circuit board 806 is used for mounting the plurality of LED chips 804 and the driver component 805.

The socket 807 has a guiding entrance 811 aligning with the cover entrance 810. The end electrode 802 of the external signal wire 801 is inserted into the guiding entrance 810.

The elastic clip 808 has a clip part 812 and an extended part 813. The extended part 813 is electrically connected to the driver component 805. The clip part 812 clips the end electrode 802 for forming an electrical connection to the driver component 802 via the extended part 813.

In some embodiments, the external signal wire includes a power wire.

Figure 10:
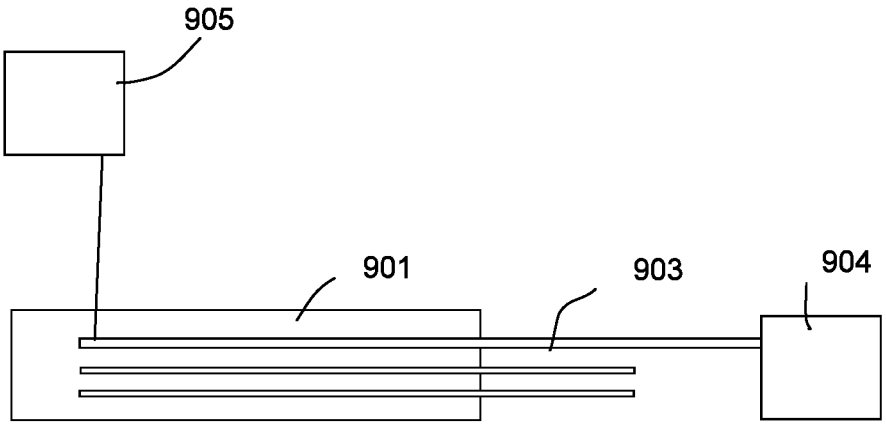
FIG. 10 shows an external signal structure.

In FIG. 10, the external signal line 901 also includes a control signal line 903 for transmitting a control signal to the driver component 904 for sending a control signal from an external control device 905 via the external signal line to the driver component 904 to control the plurality of LED chips according to the control signal. The external control device 905 may be a switch mounted on a wall for receiving an operation command of a user. The operation command is converted to the corresponding control signal sent to the driver component. For example, the operation command may be to turn-on, turn-off, increase luminance level, lower luminance level, change color temperatures. More complicated commands may be provided by combining multiple operations with more circuits. For example, a prepare-to-sleep command may correspond to lower down the light gradually and turn off after a predetermined time period. In some embodiments, there are other components on the lighting apparatus, e.g. a speaker, a camera, a smoke detector, an indicator. The control signal may be used for control these components.

In some embodiments, the signal wire may include a signal line for transmitting a control signal.

Figure 11:
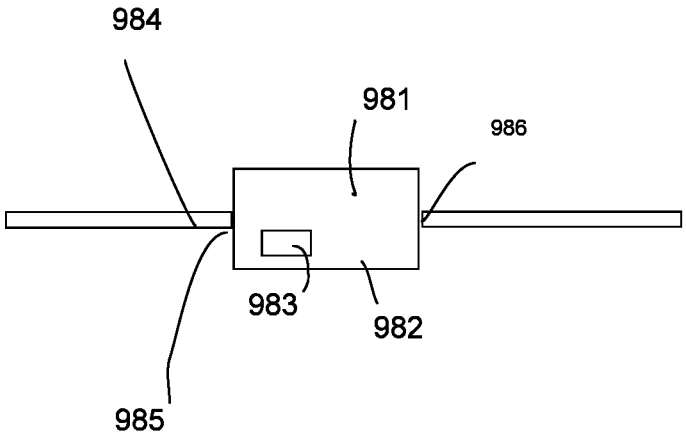
FIG. 11 shows a converter module.

In FIG. 11, the lighting apparatus may also include a converter module 981. The converter module 981 may have a box housing 982 and electronic components 983 placed within the box housing 982.

The converter module 981 may be selectively, e.g. added when needed, inserted into a section of the external signal line 984 for providing an additional control signal to the driver component.

For example, there is a position 985 detachable in the external signal line. When a first part 985 of the external signal line and a second part 986 of the external signal line 984 are separated, the first part 985 and the second part 986 trespectively have a connecting end to be connected to two ends of the converter module for inserting the converter module into the external signal wire. In other words, the power line and/or signal line passes through the converter module first and then continue to the lighting apparatus.

The converter module may add more function to the lighting apparatus when the converter module is inserted. For example, the convert module may have a wireless module for transmitting and/or receiving data to and/or from an external device. The data are processed or routed to the driver component of the lighting apparatus.

The converter module may have a manual switch exposed outside the lighting apparatus so that users may operate the manual switch to input some commands, which may be further injected to the driver component of the lighting apparatus.

In some other embodiments, the converter module may replace the control function of the driver component. In other words, when the converter module is inserted, the converter module takes over a portion of a complete function of the driver module.

When users need a different function, users just get a corresponding converter module and inserts the converter module into the external signal line to achieve the desired control function provided by the converter module. For example, a lighting apparatus may have not connection capability to external devices. By inserting a convert module that has a wireless circuit as mentioned above, the lighting apparatus may be controlled by an external device wirelessly. Such design adds lots of flexibility.

In some embodiments, the lighting apparatus may also include a converter module that is selectively inserted into the external signal line for receiving a wireless signal and the control signal, the converter module converting the wireless signal to an additional control signal supplied to the driver component via the end electrode of the external signal line.

Figure 12:
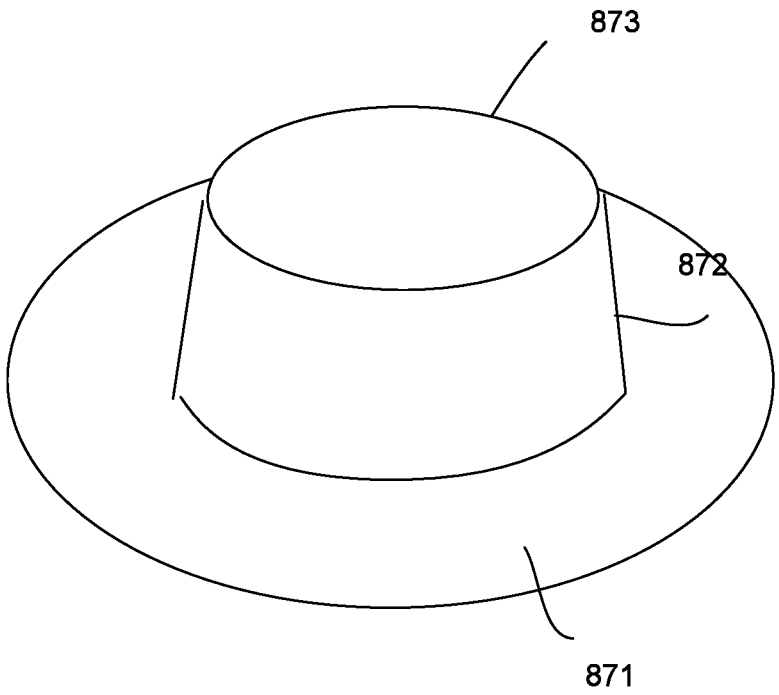
FIG. 12 shows a downlight example.

In FIG. 12, the light housing further has a rim 871 and a surrounding wall 872. A first peripheral edge of the surrounding wall is connected to the back cover 873. The light opening is at a center of the rim 871. The rim 871 is connected to a second peripheral edge of the surrounding wall 872. Such arrangement may form a downlight device that can be installed to an installation box or an installation cavity in a ceiling.

In some embodiments, the lighting apparatus may also include a heat sink like the example in FIG. 8 for mounting the printed circuit board for carrying away heat of the printed circuit board. The heat sink may be a metal cup with a top plate and a surrounding wall. the top plate is used for mounting and engaging the printed circuit board for carrying away heat of the LED chips and the driver component.

In some embodiments, an external surface of the heat sink engages an inner surface of the light housing for heat dissipation. The heat is transmitted from the printed circuit board to the light housing.

In some embodiments, there is an antenna disposed on the heat sink electrically connected to the driver component. For example, there is a portion of a heat dissipation cup, served as the heat sink, reserved for placing an antenna. Usually, an antenna has a pattern, length and width for receiving a corresponding frequency signal. The antenna may be printed or inserted to the heat dissipation cup and also connect to the driver component or a wireless module to provide connectivity.

In some embodiments, the printed circuit board includes an extending slot for plugging a function module providing an additional function to the driver component. The function module may provide a wireless function, a sensor function, or other functions for making the lighting apparatus more convenient. When such function module may be added, such function module may be replaced depending on which function users need. In some cases, the function module may be removed completely and no additional function is provided for such setting, e.g. with a lower cost.

In some embodiments, the driver component and the plurality of LED chips are disposed on opposite sides of the printed circuit board. In other words, the driver component, which may have one or more circuits, is mounted on a back side of the printed circuit board and the LED chips are placed on a front side of the printed circuit board.

In some embodiments, the driver component and the multiple LED chips are disposed at a first side of the printed circuit board. There is a second driver component having a height than the driver component being disposed at a second side of the printed circuit board. In other words, components with larger heights, like a capacitor standing upon a printed circuit with a significant height compared with other components, are placed in a back side of the printed circuit board without causing a shadow of the LED chips if these components are placed at the same side of the printed circuit board as the LED chips.

In some embodiments, the printed circuit board has an extending slot for plugging a second light source module.

In some embodiments, the second light source module has a third driver component co-working with the driver component to control the second light source module.

In some embodiments, the third driver component replaces a control function of the driver component when the second light source module is plugged to the extending slot.

In some embodiments, the clip part and the extended part are made of metal material. The clip part includes a pair of clips facing to each other and defining a clipping entrance deformed when the end electrode is inserted into the clip entrance to fix the end electrode.

In some embodiments, the elastic clip has a clip housing to be disposed on the printed circuit board.

In some embodiments, the clip housing has a top part and a bottom part disposed on opposite sides of the printed circuit board. The clip part is enclosed by the top part and the bottom part of the clip housing.

In some embodiments, the printed circuit board has a wire opening. The end electrode is inserted through a guiding entrance of the top part of the clip housing and then passes through the wire opening before being clipped by the clip part of the elastic clip. In some embodiments, the light housing has a reflective cup made as an unibody portion of the light housing.

In some embodiments, a lighting apparatus is designed for connecting to an external signal wire. The external signal wire has an end electrode. For example, the external signal wire is a power wire with two sub-wires. The two sub-wires are isolated and prevented to have direct contact which may cause short circuit problem. In the ends of the two sub-wires, there may be two electrodes as the end electrode of the external signal wire.

More than three sub-wires may be used, e.g. with a ground line and one or more control lines. In some embodiments, the external signal wire may be a power line from an indoor power source, e.g. 110V or 220V alternating current source.

The lighting apparatus has a light housing, multiple LED chips, a driver component, a printed circuit board, a socket and an elastic clip.

The light housing has a light opening and a back cover. The back cover has a cover entrance. The printed circuit board is used for mounting the plurality of LED chips and the driver component.

The socket has a guiding entrance aligning with the cover entrance. The end electrode of the external signal wire is inserted into the guiding entrance.

The elastic clip has a clip part and an extended part. The extended part is electrically connected to the driver component. The clip part clips the end electrode for forming an electrical connection to the driver component via the extended part.

In some embodiments, the external signal wire includes a power wire.

In some embodiments, the external signal line also includes a control signal line for transmitting a control signal to the driver component for sending a control signal from an external control device via the external signal line to the driver component to control the plurality of LED chips according to the control signal. The external control device may be a switch mounted on a wall for receiving an operation command of a user. The operation command is converted to the corresponding control signal sent to the driver component. For example, the operation command may be to turn-on, turn-off, increase luminance level, lower luminance level, change color temperatures. More complicated commands may be provided by combining multiple operations with more circuits. For example, a prepare-to-sleep command may correspond to lower down the light gradually and turn off after a predetermined time period. In some embodiments, there are other components on the lighting apparatus, e.g. a speaker, a camera, a smoke detector, an indicator. The control signal may be used for control these components.

In some embodiments, the signal wire may include a signal line for transmitting a control signal.

In some embodiments, the lighting apparatus may also include a converter module. The converter module may have a box housing and electronic components placed within the box housing.

The converter module may be selectively, e.g. added when needed, inserted into a section of the external signal line for providing an additional control signal to the driver component.

For example, there is a position detachable in the external signal line. When a first part of the external signal line and a second part of the external signal line are separated, the first part and the second part respectively have a connecting end to be connected to two ends of the converter module for inserting the converter module into the external signal wire. In other words, the power line and/or signal line passes through the converter module first and then continue to the lighting apparatus.

The converter module may add more function to the lighting apparatus when the converter module is inserted. For example, the convert module may have a wireless module for transmitting and/or receiving data to and/or from an external device. The data are processed or routed to the driver component of the lighting apparatus.

The converter module may have a manual switch exposed outside the lighting apparatus so that users may operate the manual switch to input some commands, which may be further injected to the driver component of the lighting apparatus.

In some other embodiments, the converter module may replace the control function of the driver component. In other words, when the converter module is inserted, the converter module takes over a portion of a complete function of the driver module.

When users need a different function, users just get a corresponding converter module and inserts the converter module into the external signal line to achieve the desired control function provided by the converter module. For example, a lighting apparatus may have not connection capability to external devices. By inserting a convert module that has a wireless circuit as mentioned above, the lighting apparatus may be controlled by an external device wirelessly. Such design adds lots of flexibility.

In some embodiments, the lighting apparatus may also include a converter module that is selectively inserted into the external signal line for receiving a wireless signal and the control signal, the converter module converting the wireless signal to an additional control signal supplied to the driver component via the end electrode of the external signal line.

In some embodiments, the light housing further has a rim and a surrounding wall. A first peripheral edge of the surrounding wall is connected to the back cover. The light opening is at a center of the rim. The rim is connected to a second peripheral edge of the surrounding wall. Such arrangement may form a downlight device that can be installed to an installation box or an installation cavity in a ceiling.

In some embodiments, the lighting apparatus may also include a heat sink for mounting the printed circuit board for carrying away heat of the printed circuit board. The heat sink may be a metal cup with a top plate and a surrounding wall. the top plate is used for mounting and engaging the printed circuit board for carrying away heat of the LED chips and the driver component.

In some embodiments, an external surface of the heat sink engages an inner surface of the light housing for heat dissipation. The heat is transmitted from the printed circuit board to the light housing.

In some embodiments, there is an antenna disposed on the heat sink electrically connected to the driver component. For example, there is a portion of a heat dissipation cup, served as the heat sink, reserved for placing an antenna. Usually, an antenna has a pattern, length and width for receiving a corresponding frequency signal. The antenna may be printed or inserted to the heat dissipation cup and also connect to the driver component or a wireless module to provide connectivity.

In some embodiments, the printed circuit board includes an extending slot for plugging a function module providing an additional function to the driver component. The function module may provide a wireless function, a sensor function, or other functions for making the lighting apparatus more convenient. When such function module may be added, such function module may be replaced depending on which function users need. In some cases, the function module may be removed completely and no additional function is provided for such setting, e.g. with a lower cost.

In some embodiments, the driver component and the plurality of LED chips are disposed on opposite sides of the printed circuit board. In other words, the driver component, which may have one or more circuits, is mounted on a back side of the printed circuit board and the LED chips are placed on a front side of the printed circuit board.

In some embodiments, the driver component and the multiple LED chips are disposed at a first side of the printed circuit board. There is a second driver component having a height than the driver component being disposed at a second side of the printed circuit board. In other words, components with larger heights, like a capacitor standing upon a printed circuit with a significant height compared with other components, are placed in a back side of the printed circuit board without causing a shadow of the LED chips if these components are placed at the same side of the printed circuit board as the LED chips.

In some embodiments, the printed circuit board has an extending slot for plugging a second light source module.

In some embodiments, the second light source module has a third driver component co-working with the driver component to control the second light source module.

In some embodiments, the third driver component replaces a control function of the driver component when the second light source module is plugged to the extending slot.

In some embodiments, the clip part and the extended part are made of metal material. The clip part includes a pair of clips facing to each other and defining a clipping entrance deformed when the end electrode is inserted into the clip entrance to fix the end electrode.

In some embodiments, the elastic clip has a clip housing to be disposed on the printed circuit board.

In some embodiments, the clip housing has a top part and a bottom part disposed on opposite sides of the printed circuit board. The clip part is enclosed by the top part and the bottom part of the clip housing.

In some embodiments, the printed circuit board has a wire opening. The end electrode is inserted through a guiding entrance of the top part of the clip housing and then passes through the wire opening before being clipped by the clip part of the elastic clip. In some embodiments, the light housing has a reflective cup made as an unibody portion of the light housing.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings.

The embodiments were chosen and described in order to best explain the principles of the techniques and their practical applications. Others skilled in the art are thereby enabled to best utilize the techniques and various embodiments with various modifications as are suited to the particular use contemplated.

Although the disclosure and examples have been fully described with reference to the accompanying drawings, it is to be noted that various changes and modifications will become apparent to those skilled in the art. Such changes and modifications are to be understood as being included within the scope of the disclosure and examples as defined by the claims.

The invention claimed is:

1. A lighting apparatus, for connecting to an external signal wire, the external signal wire having an end electrode, comprising:

a light housing having a light opening and a back cover, the back cover having a cover entrance;

a plurality of LED chips;

a driver component;

a printed circuit board for mounting the plurality of LED chips and the driver component;

a socket having a guiding entrance aligning with the cover entrance, the end electrode of the external signal wire being inserted into the guiding entrance; and an elastic clip having a clip part and an extended part, the extended part being electrically connected to the driver component, the clip part clipping the end electrode for forming an electrical connection to the driver component via the extended part, wherein the light housing further has a rim and a surrounding wall, a first peripheral edge of the surrounding wall is connected to the back cover, the light opening is at a center of the rim, the rim is connected to a second peripheral edge of the surrounding wall, wherein the clip part and the extended part are made of metal material, the clip part comprises a pair of clips facing to each other and defining a clipping entrance deformed when the end electrode is inserted into the clip entrance to fix the end electrode, wherein the elastic clip has a clip housing to be disposed on the printed circuit board, wherein the clip housing has a top part and a bottom part disposed on opposite sides of the printed circuit board, the clip part is enclosed by the top part and the bottom part of the clip housing.

2. The lighting apparatus of claim 1, wherein the external signal wire comprises a power line.

3. The lighting apparatus of claim 2, wherein the external signal line further comprises a control signal line for transmitting a control signal to the driver component for sending a control signal from an external control device via the external signal line to the driver component to control the plurality of LED chips according to the control signal.

4. The lighting apparatus of claim 3, further comprising a converter module being selectively inserted into a section of the external signal line for providing an additional control signal to the driver component.

5. The lighting apparatus of claim 4, further comprising a converter module being selectively inserted into the external signal line for receiving a wireless signal and the control signal, the converter module converting the wireless signal to an additional control signal supplied to the driver component via the end electrode of the external signal line.

6. The lighting apparatus of claim 1, wherein an external surface of the heat sink engages an inner surface of the light housing for heat dissipation.

7. The lighting apparatus of claim 1, wherein the printed circuit board comprises an extending slot for plugging a function module providing an additional function to the driver component.

8. The lighting apparatus of claim 1, wherein the driver component and the plurality of LED chips are disposed on opposite sides of the printed circuit board.

9. The lighting apparatus of claim 1, wherein the printed circuit board has an extending slot for plugging a second light source module.

10. The lighting apparatus of claim 9, wherein the second light source module has a third driver component co-working with the driver component to control the second light source module.

11. The lighting apparatus of claim 10, wherein the third driver component replaces a control function of the driver component when the second light source module is plugged to the extending slot.

12. The lighting apparatus of claim 1, wherein the printed circuit board has a wire opening, the end electrode is inserted through a guiding entrance of the top part of the clip housing and then passes through the wire opening before being clipped by the clip part of the elastic clip.

13. The lighting apparatus of claim 1, wherein the light housing has a reflective cup made as an unibody portion of the light housing.

* * * * *